US005077939A

United States Patent [19]

Erickson

[11] Patent Number: 5,077,939

[45] Date of Patent: Jan. 7, 1992

[54] CAM PIVOT FOR FULL TILT DOUBLE-HUNG WINDOWS

[75] Inventor: Steven E. Erickson, Lincoln, Nebr.

[73] Assignee: SealRite Windows, Inc., Lincoln, Nebr.

[21] Appl. No.: 618,488

[22] Filed: Nov. 27, 1990

[51] Int. Cl.[5] ..... E06B 1/00

[52] U.S. Cl. ..... 49/380; 49/181

[58] Field of Search ..... 49/181, 380, 254, 161

[56] References Cited

U.S. PATENT DOCUMENTS

| | | | |
|---|---|---|---|
| 652,273 | 6/1900 | Jones | 49/161 |
| 1,562,011 | 11/1925 | Sylvan | 49/181 |
| 2,987,758 | 6/1961 | Osten | 49/181 X |
| 3,124,849 | 3/1964 | Osten | 49/181 X |
| 3,524,282 | 8/1970 | Kraft et al. | 49/181 |
| 3,797,168 | 3/1974 | Trout | 49/181 |
| 3,842,540 | 10/1974 | Anderson | 49/181 |
| 4,364,199 | 12/1982 | Johnson et al. | 49/181 |
| 4,691,477 | 9/1987 | Governale | 49/380 |
| 4,718,194 | 1/1988 | FitzGibbon et al. | 49/181 |
| 4,854,077 | 8/1989 | Rogers et al. | 49/181 X |
| 4,887,389 | 12/1989 | Haitof | 49/181 |
| 4,922,657 | 5/1990 | Foss | 49/181 |

OTHER PUBLICATIONS

JW Window Components, Inc.'s booklet entitled: Sash Balances and Full Tilt Vinyl Jambliner for Wood Windows Designed for $1\frac{3}{8}''$ Or $1\frac{3}{4}''$ Sash.

*Primary Examiner*—Gary L. Smith
*Assistant Examiner*—Jerry Redman
*Attorney, Agent, or Firm*—Zarley McKee Thomte Voorhees & Sease

[57] ABSTRACT

A cam pivot for a full tilt, double-hung window comprising a locking lug which extends from the cam pivot and which is received between the walls of a channel-shaped slide member which is a part of a mechanical balance. The locking lug, when the sash is tilted to its vertical position, prevents separation of the cam pivot from its locking terminal during shipment or when loading.

2 Claims, 4 Drawing Sheets

CAM PIVOT FOR FULL TILT DOUBLE-HUNG WINDOWS

TECHNICAL FIELD

The present invention relates generally to double-hung windows and more particularly to a cam pivot for use with full tilt, double-hung windows which prevent separation of the cam pivot from its locking terminal when the windows are in their installed position.

BACKGROUND OF THE INVENTION

Conventional double-hung windows are mounted in a window frame which is attached to the structural framing of the surrounding wall. The window frame generally comprises a pair of horizontally spaced-apart vertical jambs having a jambliner mounted thereon which faces the window opening. Each of the jambliners includes a pair of horizontally spaced-apart and vertically disposed channels in which mechanical balances are positioned. Each sash of the conventional double-hung windows is provided with cam pivots extending laterally therefrom adjacent the lower ends thereof for connection to locking terminals associated with the mechanical balances. When the upper end of one of the sashes is tilted inwardly to facilitate the removal of the sash from the window frame, the cam pivots on the sash to permit the knife lock portion of the locking terminal to engage one wall of the associated channel so that the locking terminal will remain in place, under tension, in its respective channel during the time that the window is removed from the frame.

A problem arises in the full tilt, double-hung windows during the shipment thereof from the factory to the point of sale or use. During shipment, the jambs may bow outwardly with respect to the sashes which may cause one or more of the cam pivots which then causes the locking terminal to quickly move towards its mechanical balance. The movement of the locking terminal towards its mechanical balance is a snap-like action which may cause damage to the locking terminal or the mechanical balance itself. Further, once the window is ready for installation, the sashes must be removed and the locking terminals attempted to be repositioned in their proper position to facilitate the engagement of the cam pivots on the sashes with the locking terminals.

Further, when the full tilt, double-hung windows are subjected to wind-loading tests, the force of the wind may also cause the jambliners to deflect which also causes disengagement of the cam pivots from the locking terminals.

It is therefore a principal object of the invention to provide an improved cam pivot for a full tilt, double-hung window.

Yet another object of the invention is to provide a cam pivot for a full tilt, double-hung window which includes means for preventing the disengagement thereof with the locking terminal during shipment of the window or during wind loading of the same.

Still another object of the invention is to provide an improved cam pivot for a full tilt, double-hung window which includes a locking lug which is received between the walls of a channel on the locking terminal to prevent the separation of the same during shipment or wind loading.

These and other objects will be apparent to those skilled in the art.

SUMMARY OF THE INVENTION

An improved cam pivot is provided for a full tilt, double-hung window. The conventional full tilt, double-hung window comprises a window frame having a pair of vertical jambs each of which have a jambliner mounted therein. Each of the jambliners are provided with a pair of horizontally spaced and vertically disposed channel members which are open toward the sash sides of the window. A mechanical balance is mounted in each of the four channels and has a locking terminal associated therewith which is adapted to grip the walls of the channel to maintain the locking terminal in place in its respective channel when the sash is tilted inwardly for removal from the window frame. Each of the locking terminals includes a channel-shaped slide member. The cam pivots extending from the sashes include a locking lug which is received between the walls of the channel-shaped slide member when the sash is tilted to its vertical position thereby preventing separation of the cam pivot from its locking terminal during shipment or wind loading.

DESCRIPTION OF THE PREFERRED EMBODIMENT

Figure 1:
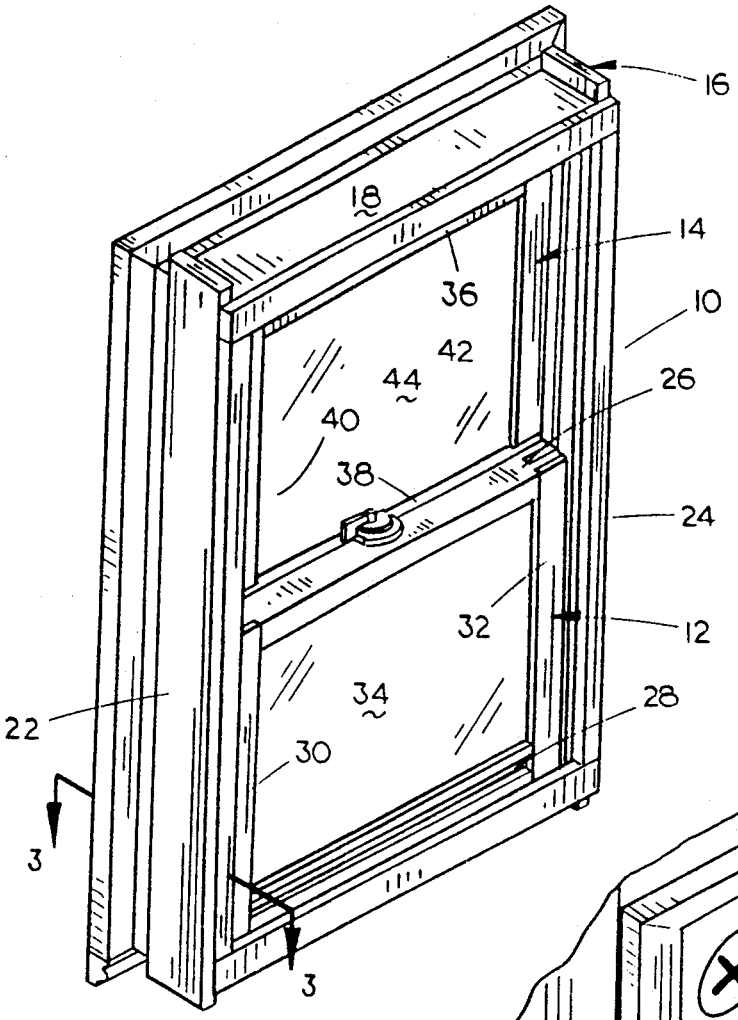
FIG. 1 is an inside perspective view of a full tilt, double-hung window installed in a frame.

Referring now to the drawings, in which identical or corresponding parts are identified with the same reference numerals throughout the drawings, and more particularly to FIG. 1, the numeral 10 generally designates a conventional full tilt, double-hung window including a movable lower sash 12 and a movable upper sash 14 mounted within a window frame 16. Window frame 16 may be attached to the structural framing of a surrounding wall in a conventional manner.

Window frame 16 includes a head 18, sill 20, and left and right jambs 22 and 24, respectively. Lower sash 12 is comprised of an upper rail 26, lower rail 28, and left and right stiles 30 and 32, with a pane of glass 34 mounted therein. Upper sash 14 is comprised of an upper rail 36, lower rail 38 and left and right stiles 40 and 42, with a pane of glass 44 mounted therebetween.

Figure 3:
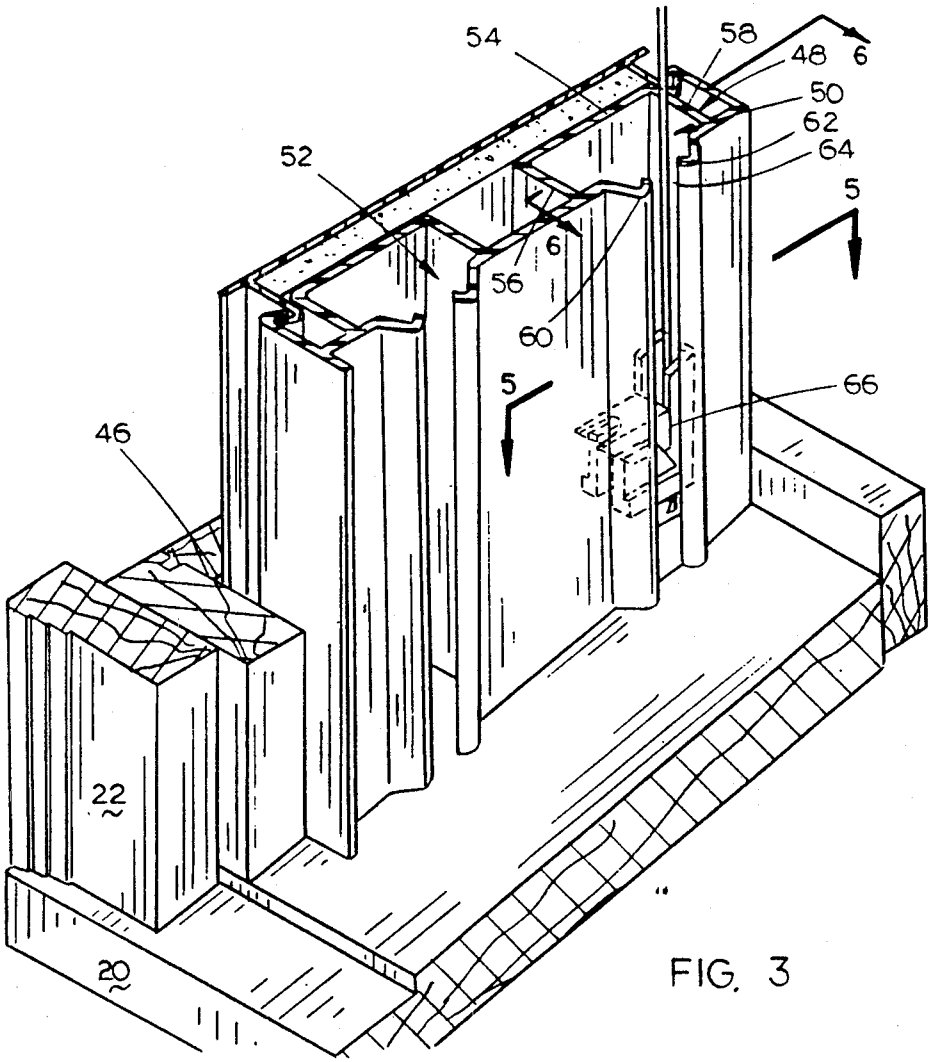
FIG. 3 is a partial perspective view of the lower portion of the right side illustrating the relationship of one of the locking terminals with its respective jambliner channel.
Figure 5:
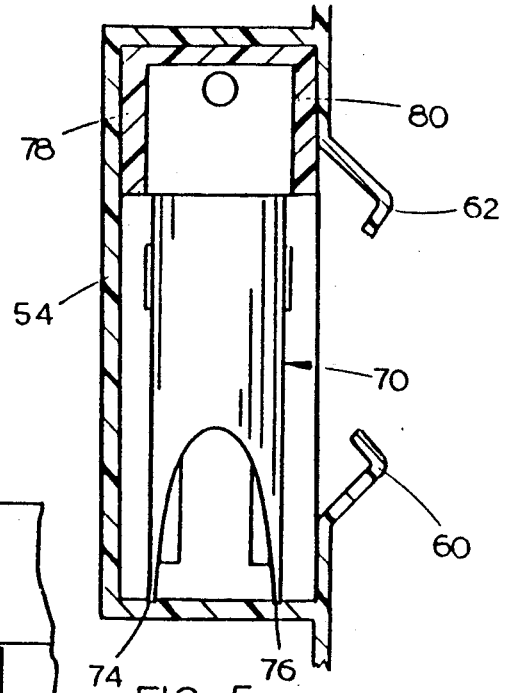
FIG. 5 is a sectional view seen on lines 5—5 of FIG. 3.

Referring to FIG. 3, it can be seen that the conventional jamb 22 includes a pocket 46 into which is mounted a jambliner 48. Jambliner 48 is provided with a pair of horizontally spaced and vertically disposed channels 50 and 52. Inasmuch as each of the channels 50 and 52 are identical, only channel 50 will be described in detail.

As seen in the drawings, channel 50 includes a base wall 54, opposite side walls 56 and 58, and arcuate portions 60 and 62 defining an opening 64 therebetween. A conventional mechanical balance such as that sold by J. W. Window Components, Inc. of 1009 Algonquin, Sioux Falls, S.D. 57104 under Model No. D-70 is installed in each of the channels 50 and 52 in conventional fashion. It should be noted at this juncture that jamb 24 is also provided with a jambliner identical to jambliner 48 and which will have a pair of channels provided therein identical to channels 50 and 52. Similarly, mechanical balances of the type described will be mounted in each of the channels in the jambliner.

Figure 6:
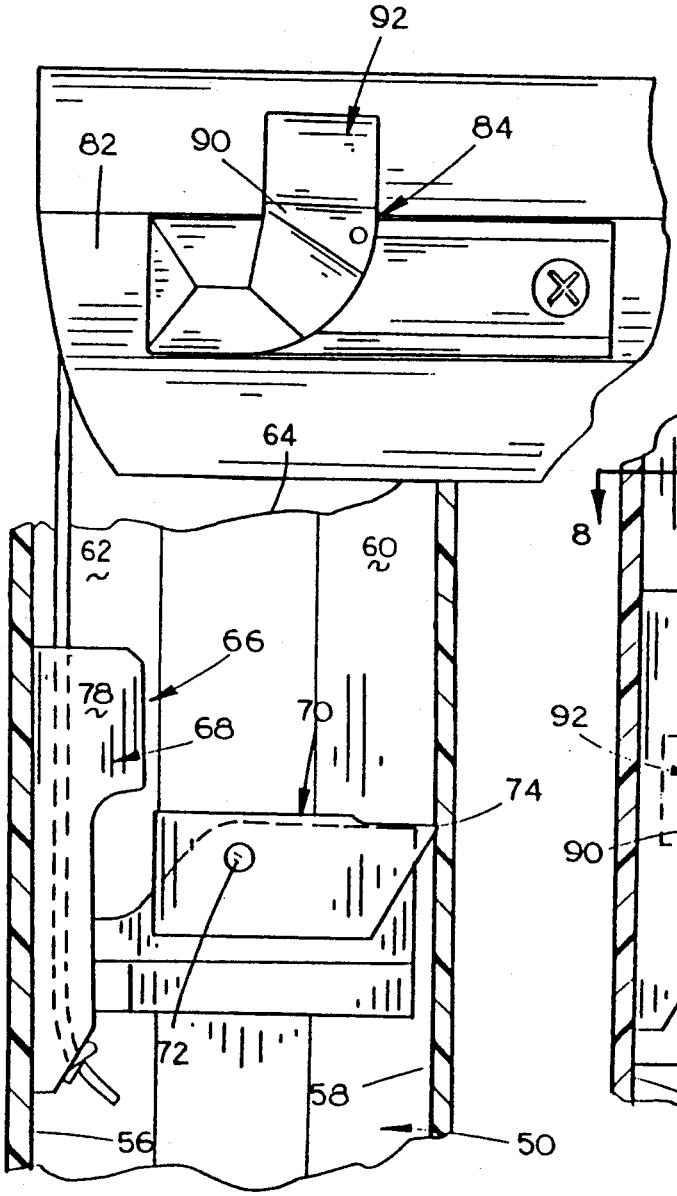
FIG. 6 is a vertical sectional view of the left hand locking terminal as seen on lines 6—6 of FIG. 3 and its relationship to a sash being installed therein; with the sash being initially horizontally disposed.

Associated with each of the mechanical balances is a locking terminal referred to generally by the reference numeral 66. As seen in FIG. 6, locking terminal 66 includes a channel-shaped slide member 68 having cord 70 secured thereto. Cord 70 extends to the mechanical balance mounted in the jambliner channel. Knife lock 70 is pivotally mounted on the slide member 68 by means of pin 72 and includes a pair of teeth 74 and 76 at one end thereof which are adapted to engage the inside surface of wall 58 at times to maintain locking terminal 66 in position in the channel 50 when the associated sash is removed from the window. The spring force exerted on the cord 70 causes the teeth 74 and 76 to grip the inside surface of wall 58 as seen in FIG. 6. Slide member 68 is provided with a pair of leg portions 78 and 80 which define a channel therebetween.

Figure 2:
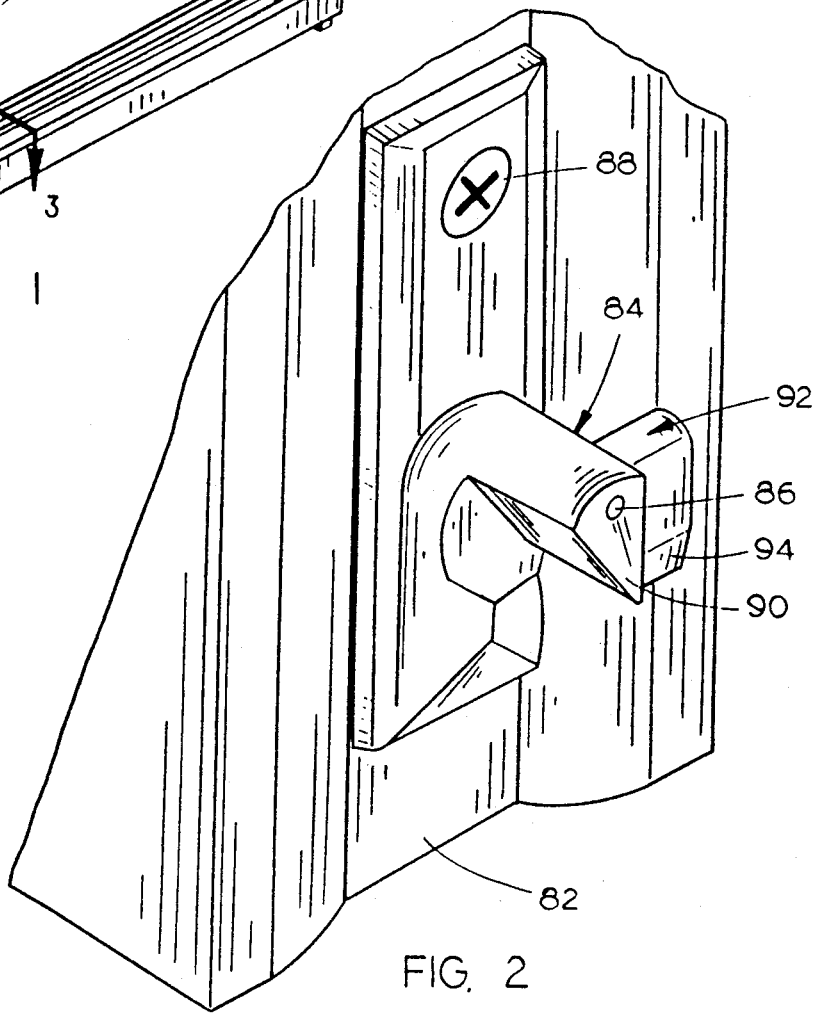
FIG. 2 is a perspective view of the cam pivot of this invention mounted in the lower left plough of one of the window sashes.
Figure 4:
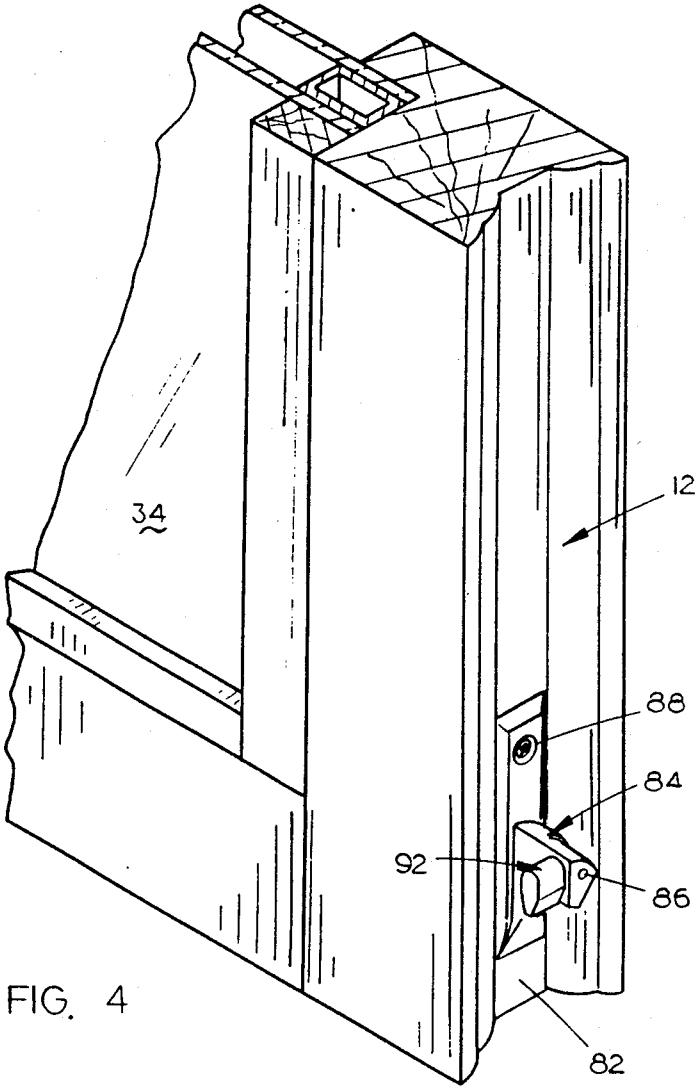
FIG. 4 is a view similar to FIG. 2 except that FIG. 4 illustrates the right-hand version of the cam pivot.

As seen in FIGS. 2 and 4, each of the sashes are provided with ploughs 82 formed in the sides thereof which are adapted to slidably embrace the arcuate portions 60 and 62 of the jambliner channels. Cam pivots 84 are mounted in the ploughs at each side of each of the sashes adjacent the lower ends thereof by means of nail 86 and screw 88. Each of the cam pivots 84 includes a V-shaped cam portion 90 which is adapted to be received between end 92 of knife lock 70 and slide member 68 to disengage teeth 74 and 76 of the knife lock 70 from the inner surface of wall 58 of channel 50 during the installation of the sash into the window frame.

Figure 7:
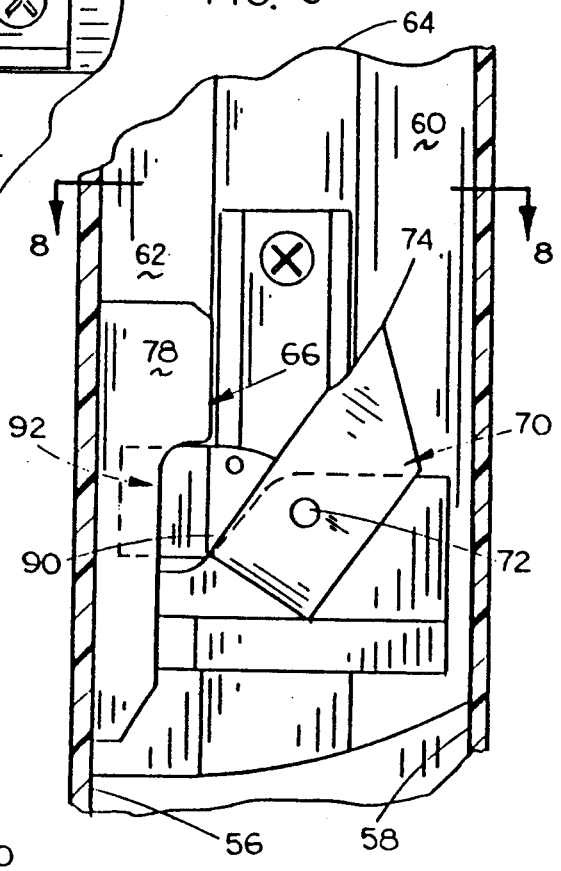
FIG. 7 is a view similar to FIG. 6 except that the cam pivot of the sash has unlocked the locking terminal.
Figure 8:
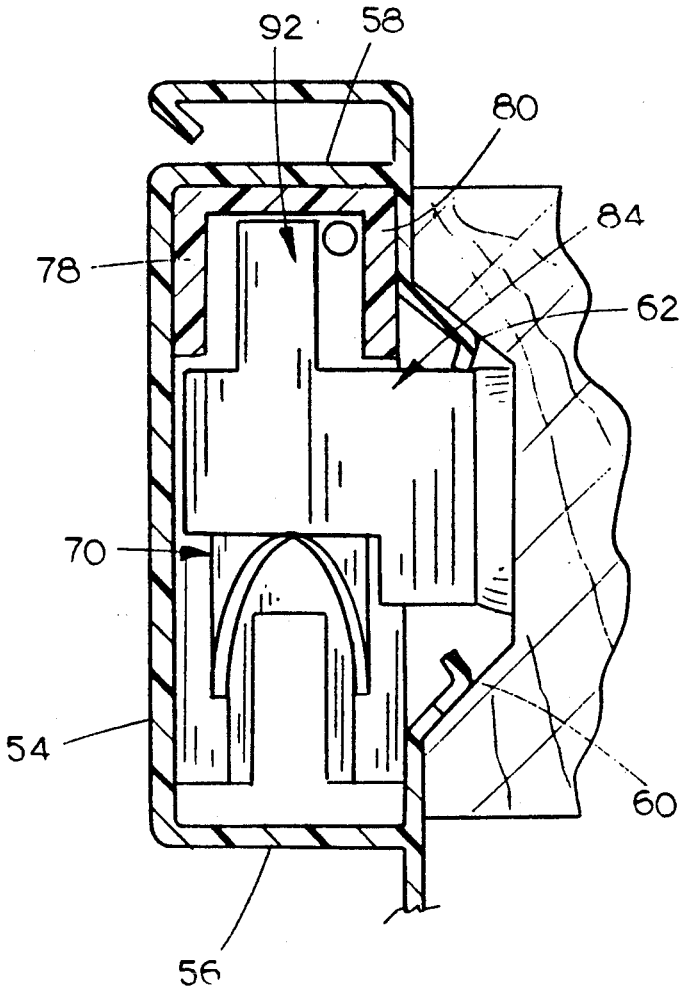
FIG. 8 is a sectional view seen on lines 8—8 of FIG. 7.

The structure describe hereinabove is conventional structure. When the window has been assembled and is being shipped or being wind-loaded, the cam portion 90 can move laterally with respect to locking terminal 66 and can thus become disengaged therefrom which will permit the locking terminal 66 to snap towards the associated mechanical balance. To prevent such separation of the cam pivot from the locking terminal 66, cam portion 90 is provided with a laterally extending locking lug 92 having a tapered portion 94 at one end thereof. As seen in FIG. 7 and in FIG. 8, when the sash has been pivoted to its vertically disposed installed position in the window frame, locking lug 92 is positioned between the sides 78 and 80 of slide member 68 with the side walls 78 and 80 preventing lateral movement of cam pivot 84 with respect to the locking terminal 66. The tapered portion 94 on the end of locking lug 92 facilitates the locking lug moving into place between the walls 78 and 80.

Thus it can be seen that a novel cam pivot has been provided which includes a locking lug received between the walls of the slide member of the locking terminal so that the relationship thereof prevents the cam pivot from separating from the locking terminal should the jambs be bowed outwardly during shipment or wind loading. Thus it can be seen that the invention accomplishes at least all of its stated objectives.

I claim:

1. In combination, a window frame having a pair of vertical jambs mounted to a surrounding wall, each of said jambs including a vertically-extending jamb pocket for receiving a jambliner therein, a first jambliner mounted in one said jamb pockets, a second jambliner mounted in the other of said jamb pockets, each of said first and second jambliners having first and second vertically disposed and horizontally spaced channels formed therein, each of said channels including a base wall and spaced-apart side walls, an upper sash selectively vertically and removably mounted between said first and second jambliners adjacent said first channels, a lower sash selectively vertically and removably mounted between said first and second jambliners adjacent said second channels, a mechanical balance mounted in the upper ends of each of said channels and including a cord extending downwardly therefrom in its respective channel, a knife lock locking terminal mounted in each of said channels below the associated mechanical balance, each of said locking terminals being secured to the mechanical balance cord in the respective channel, each of said knife lock locking terminals comprising a channel-shaped slide member including a base portion and opposing side portions, said base portion of said slide member being closely positioned to one of said side walls of the associated jambliner channel, said side portions of said slide member extending towards the other of said side walls of the associated jambliner channel, a knife lock pivotally mounted on said slide member for selective engagement with the other of said side walls of the associated jambliner channel to lock said locking terminal in place within its channel when the upper end of the associated sash is tilted inwardly from between said jambliners, each of said sashes having a cam pivot pin extending from the opposite sides thereof adjacent the lower end thereof, each of said cam pivot pins adapted to engage one of said knife locks to cause said knife lock to move out of engagement with the said other side wall as the upper end of said sash is tilted upwardly from a substantially horizontal position between said jambliners to a vertical position, each of said cam pivot pins having a locking lug extending therefrom which is positioned between said side walls of said slide member channel to prevent said cam pivot pin from disengaging from said locking terminal when the associated sash is mounted between said jambliners.

2. In combination, a window frame having a pair of vertical jambs mounted to a surrounding wall, each of said jambs including a vertically-extending jamb pocket for receiving a jambliner therein, a first jambliner mounted in one said jamb pockets, a second jambliner mounted in the other of said jamb pockets, each of said first and second jambliners having first and second vertically disposed and horizontally spaced channels formed therein, each of said channels including a base wall and spaced-apart side walls, an upper sash selectively vertically and removably mounted between said first and second jambliners adjacent said first channels, a lower sash selectively vertically and removably mounted between said first and second jambliners adjacent said second channels, a mechanical balance mounted in the upper ends of each of said channels and including a cord extending downwardly therefrom in its respective channel, a knife lock locking terminal mounted in each of said channels below the associated mechanical balance, each of said locking terminals being secured to the mechanical balance cord in the respective channel, each of said knife lock locking terminals comprising a channel-shaped slide member including a base portion and opposing side portions, said base portion of said slide member being closely positioned to one of said side walls of the associated jambliner channel, said side portions of said slide member extending towards the other of said side walls of the associated jambliner channel, a knife lock pivotally mounted on said slide member for selective engagement with the other of said side walls of the associated jambliner channel to lock said locking terminal in place within its channel when the upper end of the associated sash is tilted inwardly from between said jambliners, each of said sashes having a cam pivot pin extending from the opposite sides thereof adjacent the lower end thereof, each of said cam pivot pins adapted to engage one of said knife locks to cause said knife lock to move out of engagement with the said other side wall as the upper end of said sash is tilted upwardly from a substantially horizontal position between said jambliners to a vertical position, and means on each of said cam pivot means for preventing said cam pivot means from disengaging from its associated locking terminal when the associated sash is mounted between said jambliners.

* * * * *